US011178493B2

(12) United States Patent
Hiraoka et al.

(10) Patent No.: US 11,178,493 B2
(45) Date of Patent: Nov. 16, 2021

(54) ELECTROACOUSTIC TRANSDUCER

(71) Applicants: PANASONIC CORPORATION, Osaka (JP); KYOTO UNIVERSITY, Kyoto (JP); National University Corporation YOKOHAMA National University, Kanagawa (JP)

(72) Inventors: Hidetoshi Hiraoka, Kyoto (JP); Yoshinobu Tsujii, Kyoto (JP); Keita Sakakibara, Kyoto (JP); Ken Nakano, Kanagawa (JP)

(73) Assignees: Panasonic Corporation, Osaka (JP); KYOTO UNIVERSITY, Kyoto (JP); National University Corporation YOKOHAMA National University, Kanagawa (JP)

( * ) Notice: Subject to any disclaimer, the term of this patent is extended or adjusted under 35 U.S.C. 154(b) by 0 days.

(21) Appl. No.: 16/831,245

(22) Filed: Mar. 26, 2020

(65) Prior Publication Data

US 2020/0228900 A1 Jul. 16, 2020

Related U.S. Application Data

(63) Continuation of application No. PCT/JP2018/034345, filed on Sep. 18, 2018.

(30) Foreign Application Priority Data

Sep. 28, 2017 (JP) ..... JP2017-189165

(51) Int. Cl.
*H04R 9/04* (2006.01)
*H04R 7/12* (2006.01)
(Continued)

(52) U.S. Cl.
CPC ..... *H04R 9/046* (2013.01); *H04R 7/12* (2013.01); *H04R 7/18* (2013.01); *H04R 9/025* (2013.01); *H04R 9/06* (2013.01); *H04R 2400/11* (2013.01)

(58) Field of Classification Search
CPC .. H04R 9/025; H04R 9/027; H04R 2209/022; H04R 2209/041
See application file for complete search history.

(56) References Cited

U.S. PATENT DOCUMENTS 10,844,176 B2 * 11/2020 Igarashi ..... C08G 77/06
2004/0037446 A1 2/2004 Hasegawa et al.
(Continued)

FOREIGN PATENT DOCUMENTS

JP S54-077127 6/1979
JP 55-155191 11/1980
(Continued)

OTHER PUBLICATIONS https://www.sciencedirect.com/topics/materials-science/viscoelastic-material; Trenton E. Gould, . . . Scott G. Piland, 2019 (Year: 2017).*
(Continued)

*Primary Examiner* — Sunita Joshi
(74) *Attorney, Agent, or Firm* — Greenblum & Bernstein, P.L.C.

(57) ABSTRACT

An electroacoustic transducer includes: a diaphragm; a magnetic circuit having a magnetic gap; a frame that holds the diaphragm and the magnetic circuit; a voice coil having one end portion positioned within the magnetic gap and the other end portion coupled to the diaphragm; and a low friction material that is disposed in a sliding portion formed by the voice coil and the magnetic circuit, and includes polymer compounds swollen with liquid.

14 Claims, 5 Drawing Sheets

(51) Int. Cl.

| | |
|---|---|
| ***H04R 7/18*** | (2006.01) |
| ***H04R 9/02*** | (2006.01) |
| ***H04R 9/06*** | (2006.01) |

(56) References Cited

U.S. PATENT DOCUMENTS

| | | | | |
|---|---|---|---|---|
| 2005/0041830 | A1* | 2/2005 | Takewa | H04R 9/04 381/410 |
| 2007/0025586 | A1* | 2/2007 | Young | H04R 9/046 381/410 |

FOREIGN PATENT DOCUMENTS

| | | | |
|---|---|---|---|
| JP | 05284595 | A * | 10/1993 |
| JP | 2003-032791 | | 1/2003 |
| JP | 2013-157735 | | 8/2013 |
| JP | 2014-169787 | | 9/2014 |

OTHER PUBLICATIONS https://www.sciencedirect.com/topics/materials-science/polymer-gel;O.E.Philippova, A.R.Khoklov,2012 (Year: 2012).*

Official Communication issued in International Patent Application No. PCT/JP2018/034345, dated Dec. 4, 2018, along with an English translation thereof.

Notice of Reasons for Refusal issued in Japanese Patent Application No. 2017-189165, dated Jun. 15, 2021, machine translation.

Yoshinobu Tsujii, "Reduce machine friction with soft nano-sized brush", JST news, Jun. 2017, partial translation.

Yoshinobu Tsujii, "Concentrated Polymer Brushes and Tribology", Sen'Igakkaishi (Sen'i To Kogyo), vol. 64, No. 5 (2008), partial translation.

Yoshiyuki Saruwatari et al. "Development of Superhydrophilic Coating Material", Osaka Organic Chemical Industry Ltd., Won the Osaka Industrial Research Association Gijyutu award, 2013, partial translation.

* cited by examiner

ELECTROACOUSTIC TRANSDUCER

CROSS REFERENCE TO RELATED APPLICATIONS

This is a continuation application of PCT International Application No. PCT/JP2018/034345 filed on Sep. 18, 2018, designating the United States of America, which is based on and claims priority of Japanese Patent Application No. 2017-189165 filed on Sep. 28, 2017.

FIELD

The present disclosure relates to an electroacoustic transducer including a device that converts an electrical signal into sound, such as a loudspeaker, and a device that converts sound into an electrical signal, such as a microphone.

BACKGROUND

In recent years, a loudspeaker which is one of electroacoustic transducers including magnetic fluid has been disclosed (see PTL 1). The magnetic fluid is disposed between a voice coil disposed in a magnetic gap of a magnetic circuit and a plate included in the magnetic circuit. In such a conventional loudspeaker, the magnetic fluid is disposed between the voice coil and the plate, and thereby the voice coil moves along only one axis as much as possible to achieve high sound quality.

CITATION LIST

Patent Literature

PTL 1: Japanese Unexamined Patent Application Publication No. 2013-157735

SUMMARY

However, the loudspeaker according to PTL 1 can be improved upon.

In view of this, the present disclosure provides an electroacoustic transducer capable of improving upon the above related art.

An electroacoustic transducer according to one aspect of the present disclosure is configured to include polymer compounds swollen with liquid as a low friction material in a sliding portion of the electroacoustic transducer having the sliding portion.

An electroacoustic transducer according to one aspect of the present disclosure is capable of improving upon the above related art.

BRIEF DESCRIPTION OF DRAWINGS

These and other advantages and features of the present disclosure will become apparent from the following description thereof taken in conjunction with the accompanying drawings that illustrate a specific embodiment of the present disclosure.

Figure 1:
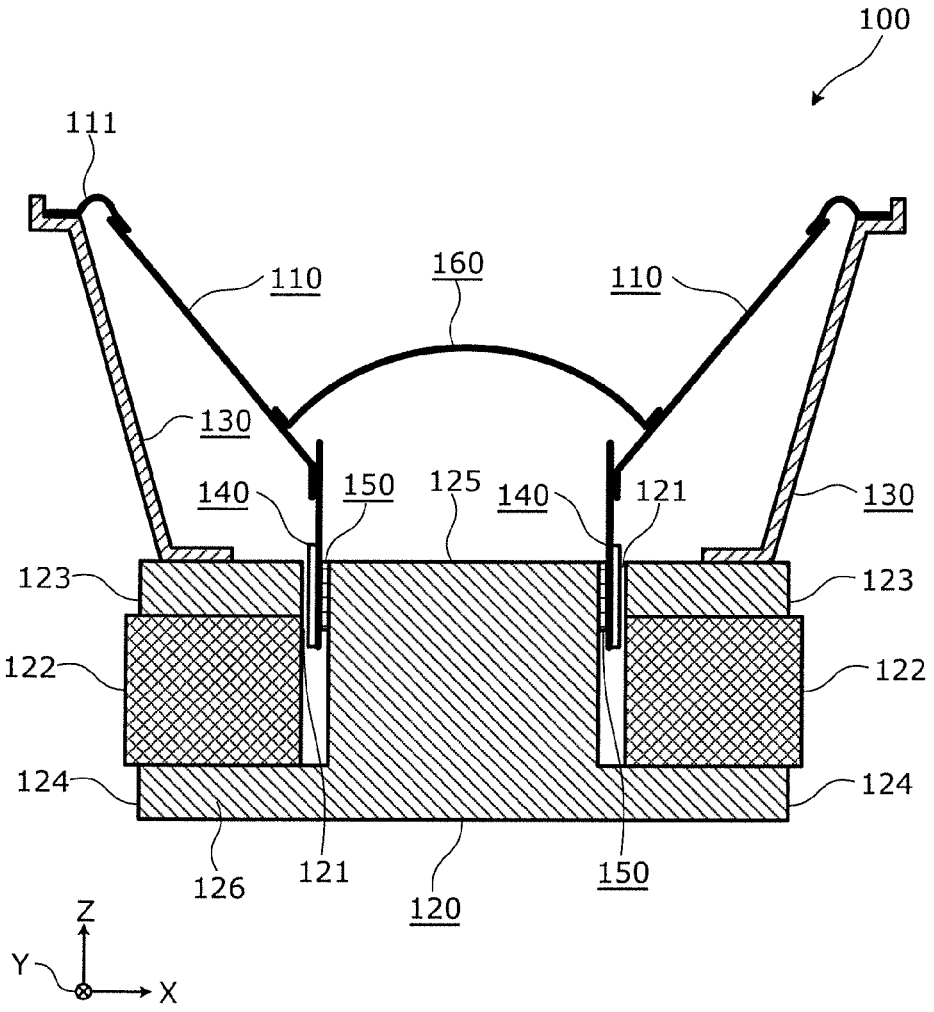
FIG. 1 is a sectional view illustrating a loudspeaker according to Embodiment 1.

DESCRIPTION OF EMBODIMENTS (Underlying Knowledge Forming Basis of the Present Disclosure)

In mutual conversion of an electrical signal and sound, it is desired to cause a diaphragm to vibrate preciously along one axis. However, in order to cause the diaphragm to vibrate along one axis, a guide for the linear motion of the diaphragm is needed.

As the guide for the diaphragm, magnetic fluid is conventionally used in a sliding portion. The inventors found that there is the following problem on loudspeakers including magnetic fluid.

In other words, the magnetic fluid is in a liquid state, and thus may be scattered due to movement of a voice coil or wind pressure caused by vibration of the diaphragm. In particular, when the temperature of the magnetic fluid increases due to Joule heat generated in the voice coil or usage environment of the loudspeaker, the viscosity decreases and the possibility of scattering increases. It is found that when the viscosity of the magnetic fluid is increased to prevent the scattering, the friction against the voice coil increases and the output sound pressure decreases.

It is also found that the magnetic fluid is drawn by capillarity action into a gap generated in manufacturing a magnetic circuit or caused by aging deterioration, and thus the magnetic fluid decreases or leaks outside.

The present disclosure has been conceived in view of the above knowledge. In other words, an electroacoustic transducer according to one aspect of the present disclosure is configured to include polymer compounds swollen with liquid in a sliding portion of the electroacoustic transducer having the sliding portion. In particular, the polymer compounds may have a stress concentration relief structure. More specifically, the stress concentration relief structure is, for example, a structure in which straight-chain shaped polymer compounds are arranged in a brush shape, a sea-island structure including various types of polymers having different flexibility, etc. In detail, the electroacoustic transducer for mutually converting an electrical signal into sound and sound into an electrical signal includes: a diaphragm that produces sound by vibration or vibrates by sound; and a guide system that guides vibration for the diaphragm along one axis, in which the guide system includes: a first component coupled to the diaphragm; and a second component that guides the first component along the one axis, and forms the sliding portion along with the first component.

With this, the first component slides with low friction over the second component, and thus it may be possible to guide vibration of the diaphragm along one axis with low friction. Accordingly, it may be possible to prevent lateral vibration or the like of the diaphragm to achieve transformation into an electrical signal true to original sound or production of sound true to original sound.

Here, "slide" means that two different components move smoothly against each other. However, in this specification and claims, "slide" also means that two different component move smoothly against and in indirect contact with as well as in direct contact with each other. For example, "move smoothly against and in indirect contact with each other" means that one component moves along the other component with another component, such as a low friction material, provided therebetween. Moreover, the "sliding portion" means a portion in which two different components move smoothly against each other. However, in this specification and claims, the "sliding portion" also means a portion in which two different components are not in contact with each other, but move smoothly against each other in their relative movement.

Moreover, lateral vibration or the like of the voice coil is also prevented for the same reason as the diaphragm, and thus it may be possible to use a magnetic circuit having a magnetic gap whose gap length is shorter. Accordingly, a magnetic circuit having a high magnetic efficiency can be achieved by preventing a leak of magnetic flux, and thus it may be possible to improve the output sound pressure. At the same time, the diaphragm can be downsized, and thus it may be possible to downsize the electroacoustic transducer. In addition, a magnet or yoke for obtaining a magnetic flux density required in the magnetic gap can be downsized since a leak of magnetic flux is prevented. Also in this case, it may be possible to reduce the size or weight of the electroacoustic transducer.

Moreover, when the voice coil is used as the first component, and the magnetic circuit is used as the second component, and the low friction material is applied to at least one of an outer peripheral surface of the voice coil, an inner peripheral surface of the voice coil, an outer peripheral surface of the magnetic gap, or an inner peripheral surface of the magnetic gap, an advantageous effect may be obtained.

With this, the magnetic circuit having the magnetic gap and the voice coil forms the guide system, and the magnetic gap guides the back and forth movement of the voice coil using the low friction material. Thus, it may be possible to determine the gap length of the magnetic gap to be on the order of the thickness of the voice coil. Accordingly, it may be possible to more strongly exert the foregoing effect of shortening the gap length.

The first component may be a bar-shaped component extending toward the magnetic circuit from the diaphragm or a center cap coupled to the diaphragm, the magnetic circuit also serving as the second component may include a guide that guides the first component along one axis, and the low friction material may be applied to at least one of the first component or the guide.

With this, the first component for guiding the diaphragm along one axis is provided separately from the voice coil, and thus the shape, material, or the like of the first component can be selected as needed. Accordingly, it is possible to improve the flexibility of design of the electroacoustic transducer. It is also possible to reduce the amount of the low friction material for use in the electroacoustic transducer.

Moreover, a gap length of the magnetic gap may be longer than and at most three times as long as a thickness of the voice coil.

Moreover, an earphone according to one aspect of the present disclosure includes the electroacoustic transducer as a micro loudspeaker.

With this, an advantageous effect similar to that of the electroacoustic transducer according to one aspect of the present disclosure can be obtained.

Next, embodiments of the electroacoustic transducer according to the present disclosure will be described with reference to the drawings. It should be noted that the following embodiments merely show examples of the electroacoustic transducer according to the present disclosure. Accordingly, the present disclosure is defined by the wordings in claims with reference to the following embodiments, and is not limited to only the following embodiments. Therefore, among the structural components in the following embodiments, components not recited in the independent claim which indicates the broadest concept of the present disclosure are not necessarily required to improve upon the above related art, but are described as components included in other advantageous embodiments.

Moreover, for the sake of illustrating the present disclosure, the drawings are schematic views in which emphasis, omission, or ratio adjustment is added as needed, and may differ in shape, positional relationship, or ratio from the actual ones.

Embodiment 1

FIG. 1 is a sectional view illustrating a loudspeaker according to Embodiment 1.

As shown in FIG. 1, electroacoustic transducer 100 is a loudspeaker that converts an electrical signal into sound, and includes diaphragm 110, magnetic circuit 120, frame 130, voice coil 140, and concentrated polymer brush 150 as a low friction material. In this embodiment, center cap 160 is provided in the center of diaphragm 110. It should be noted that in electroacoustic transducer 100, a direction along which sound is emitted from electroacoustic transducer 100 is represented as "forth", and the opposite direction is represented as "back".

Diaphragm 110 is a component coupled to voice coil 140 and displaced back and forth (in the z-axis direction in the drawings) from the neutral position in accordance with the movement of voice coil 140 to produce sound by vibrating the air. In this embodiment, diaphragm 110 has a cone shape in which the diameter gradually decreases from the front (the positive side of the z-axis in the drawings) to the back. The outer circumferential rim portion of diaphragm 110 is coupled to the edge rim portion of frame 130 through surround 111 which is more flexible and resilience than diaphragm 110.

It should be noted that the shape or the like of diaphragm 110 is not particularly limited. A circular cone, an elliptical cone, or a pyramid can be taken as an example. A flat shape such as a circular plate, an elliptical plate, or a flat plate is also possible.

The material of diaphragm 110 is not particularly limited. For example, a paper or a resin can be listed.

Moreover, in this embodiment, a damper is not attached to diaphragm 110. This is because, due to an effect of concentrated polymer brush 150 described below, voice coil 140 linearly moves back and forth (in the z-axis direction in the drawings) and thus a damper is not required. Moreover, such a damper-less structure can lower the minimum resonance frequency of electroacoustic transducer 100, i.e. a loudspeaker, and thus it is possible to improve the sound quality. Such a damper-less structure also can reduce the number of components and the number of assembly steps, and thus it is possible to achieve a low cost.

In this embodiment, a damper is not included, but a damper may be added as necessary. The damper supports voice coil 140 and frame 130, thereby increasing the centering force of voice coil 140. Accordingly, when the damper is applied to high-resistance-input type electroacoustic transducer 100 or high-amplitude-stroke electroacoustic transducer 100, more reliable vibration can be achieved.

Magnetic circuit 120 is a component for generating permanent magnetic flux acting on magnetic flux changed by voice coil 140 in accordance with an electrical signal. Magnetic circuit 120 is fixed to frame 130 to be positioned behind diaphragm 110, and has annular magnetic gap 121 opposite diaphragm 110. Magnetic gap 121 is a space in which permanent magnetic flux is generated across the magnetic flux generated in voice coil 140. In this embodiment, the gap length of magnetic gap 121 is longer than and at most three times as long as the thickness of a part of voice coil 140 inserted into magnetic gap 121. Moreover, a clearance between the magnetic gap and the part of voice coil inserted into the magnetic gap is at least 0.01 μm and less than 200 μm.

In this embodiment, magnetic circuit 120 is an outer magnet type, and includes cylinder-shaped magnet 122 magnetically attached in the back and forth direction, annular top plate 123 disposed on the surface of magnet 122 facing diaphragm 110, circular bottom plate 124 disposed on the opposite surface of magnet 122 to top plate 123, and center pole 125 extending into a through hole of top plate 123 from the center portion of bottom plate 124 and forming magnetic gap 121 between top plate 123 and center pole 125. Moreover, bottom plate 124 and center pole 125 are integrally formed.

Top plate 123, bottom plate 124, and center pole 125 are made from a magnetic material. As magnet 122, for example, a neodymium magnet having high magnetic energy may be used. With this, the thickness of magnet 122 can be reduced, and thus the thickness of whole electroacoustic transducer 100 also can be reduced. Furthermore, it is possible to achieve the weight saving.

It should be noted that the type of magnetic circuit 120 included in electroacoustic transducer 100 is not particularly limited. An inner magnet type magnetic circuit 120 may be employed.

Magnet 122 is a circular-plate-shaped permanent magnet having, in the center, a through hole into which center pole 125 is extended. Magnet 122 has one end representing the north pole and the other end representing the south pole in the thickness direction (in the back and forth direction). Top plate 123 is fixed to the surface of magnet 122 on the north pole side or on the south pole side, and bottom plate 124 is fixed to the opposite surface of magnet 122. The method for fixing top plate 123, magnet 122, and bottom plate 124 is not particularly limited. In this embodiment, they are fixed with an adhesive. It should be noted that they may be fixed with a fastener such as a screw or a rivet.

Frame 130 is a structural base component of electroacoustic transducer 100, and holds magnetic circuit 120 and diaphragm 110 to be disposed in predetermined positions. For example, frame 130 is made from metal, a resin, etc.

Voice coil 140 is a component that has a back end portion positioned within magnetic gap 121 of magnetic circuit 120 and a front end portion coupled to diaphragm 110, generates magnetic flux from an inputted electrical signal, and moves back and forth by interacting with magnetic circuit 120.

The coil axis (central axis) of voice coil 140 is aligned with the vibration (amplitude) direction of diaphragm 110 (in the z-axis direction in the drawings), and is orthogonal to the magnetic flux lines in magnetic gap 121.

In this embodiment, voice coil 140 includes a coil made by winding a metal wire in a helical shape (a cylindrical shape), and a bobbin on which the metal wire is wound. The bobbin is a cylindrical component made from a material such as aluminum or resin, and has a front end portion coupled to diaphragm 110 and a back end portion positioned within magnetic gap 121. It should be noted that voice coil 140 included in electroacoustic transducer 100 is not limited to this. For example, voice coil 140 without a bobbin as used in a micro speaker may be used.

Figure 2:
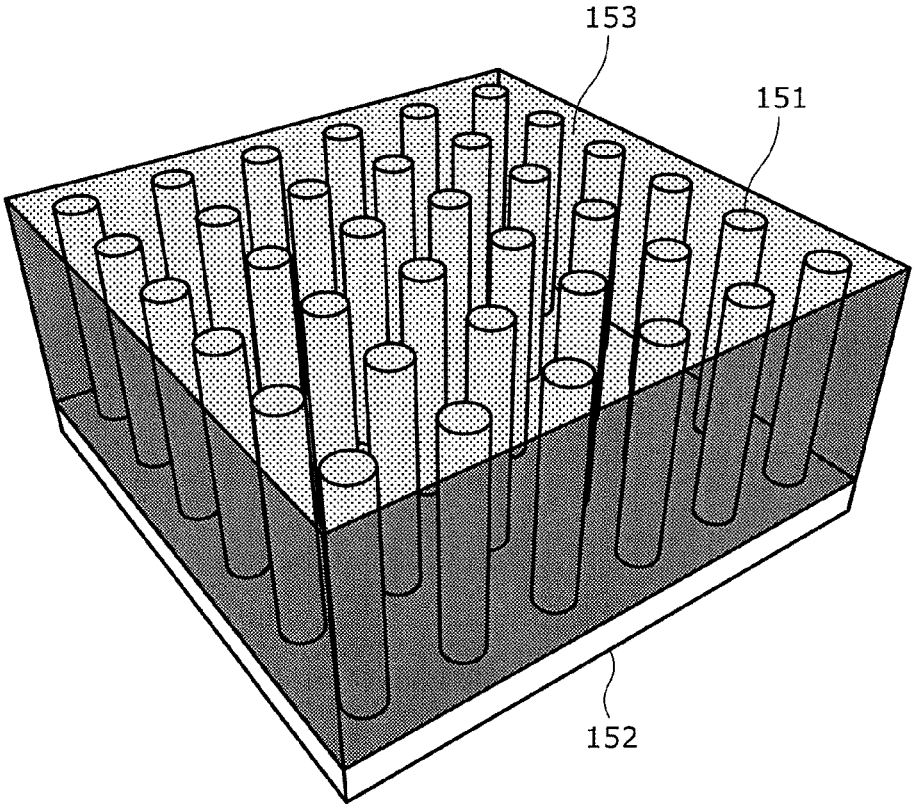
FIG. 2 is a perspective view schematically illustrating a concentrated polymer brush.

FIG. 2 is a perspective view schematically illustrating a concentrated polymer brush.

The concentrated polymer brush (CPB) is a component in which multiple polymer chains 151 are chemically or physically fixed to the surface of base 152 and swollen with liquid 153. In concentrated polymer brush 150, polymer chains 151 are fixed to the surface of base 152 in contact with each other. More specifically, the surface occupancy of polymer chains 151 is at least 10%. In a state swollen with liquid 153, concentrated polymer brush 150 has a structure in which each of polymer chains 151 is vertically elongated from the surface of base 152.

In a polymer brush having the surface occupancy of less than 10%, molecular chains are bent or curved, and thus an ideal brush structure is not established. Accordingly, even if such a polymer brush is swollen with liquid, its low frictional properties are less than that of the concentrated polymer brush.

Each polymer chain 151 is formed by polymerizing monomers into a straight-chain polymer using a precise polymerization method such as a living radical polymerization method, and a monomer type, a combination of monomers, and the like are appropriately selected based on a required performance, etc. Methacrylate polymer can be taken as an example of polymer chain 151. One specific example is polymethyl methacrylate. The length of polymer chain 151 is not particularly limited, but one specific example is about 1 μm of length. Moreover, an example of the interval between polymer chains 151 serving as concentrated polymer brush 150 is 4 nm.

Liquid 153 penetrating polymer chains 151 is not particularly limited, but it is preferred that the liquid shows a high liquidity ranging from 1 mPa·s to 2000 mPa·s inclusive at room temperature. With this, the low frictional properties can be achieved by sliding caused by the liquid on the surface of polymer chain 151. In addition, stress concentration does not occur due to the flexibility of polymer chain 151 which is not three-dimensional crosslinked, and the toughness is high. Accordingly, the low frictional characteristics can be obtained. Moreover, the liquid-holding ability of polymer chains 151 arranged in a brush shape allows the low frictional performance to be maintained. Furthermore, the melting point of liquid 153 may be −40 degrees Celsius or less. This takes into account the usage environment of electroacoustic transducer 100. The boiling point may be 180 degrees Celsius or more. This takes into account Joule heat, etc. generated in electroacoustic transducer 100, specifically, for a loudspeaker, generated in voice coil 140.

As an example of liquid 153 having such characteristics, ionic liquid can be taken. The ionic liquid is a material which is still liquid even at room temperature by substituting inorganic ion included in inorganic salt with any given organic ion having a size larger than the inorganic ion, and is characterized by being non-volatile, being non-freezing, having a high boiling point, etc. Concentrated polymer brush 150 having high environmental stability can be achieved by swelling polymer chains 151 with this ionic liquid. Moreover, even when the ion liquid is heated by Joule heat generated in voice coil 140, the ion liquid does not boil and keeps a stable state.

In this embodiment, concentrated polymer brush 150 is provided on the outer peripheral surface of diaphragm 110-side end portion of center pole 125. Base 152 of concentrated polymer brush 150 is center pole 125, and one end of polymer chain 151 is fixed to the outer peripheral surface of center pole 125 and polymer chain 151 extends toward voice coil 140. Moreover, voice coil 140 is in contact with center pole 125 through concentrated polymer brush 150. In other words, voice coil 140 coupled to diaphragm 110 serves as the first component, center pole 125 serves as the second component held by frame 130, and a guide system for guiding the vibration of diaphragm 110 in a back and forth direction along one axis (in the z-axis direction in the drawings) is formed using concentrated polymer brush 150 disposed in the sliding portion formed by voice coil 140 and center pole 125.

Next, the operation of electroacoustic transducer 100 according to the above embodiment will be described. When an electrical signal is provided to voice coil 140, magnetic flux corresponding to the electrical signal is generated in voice coil 140, and voice coil 140 moves back and forth by interacting with permanent magnetic flux in magnetic gap 121.

Here, voice coil 140 is in contact with center pole 125 through concentrated polymer brush 150, and thus voice coil 140 serves as the first component and moves only in a back and forth direction which is the extending direction of center pole 125. Diaphragm 110 coupled to voice coil 140 also moves in the back and forth direction while being prevented from waving or laterally vibrating. Moreover, although voice coil 140 and concentrated polymer brush 150 slide over each other, concentrated polymer brush 150 has low friction, and thus the friction force has little effect on the movement of voice coil 140. Accordingly, it is possible to transmit, to diaphragm 110, vibration accurately corresponding to an electrical signal provided to the coil of voice coil 140, thereby achieving production of sound true to original sound.

Moreover, voice coil 140 moves along center pole 125 only in one axis direction, and thus the gap length of magnetic gap 121 in magnetic circuit 120 can be significantly shortened. Accordingly, it is possible to prevent a leak of magnetic flux generated in magnetic gap 121 to increase the magnetic flux density, thereby achieving electroacoustic transducer 100 capable of producing high sound pressure.

Moreover, even when diaphragm 110, magnet 122, or the like is downsized, it is possible to provide electroacoustic transducer 100 capable of producing a desired sound pressure and to downsize electroacoustic transducer 100.

Figure 3:
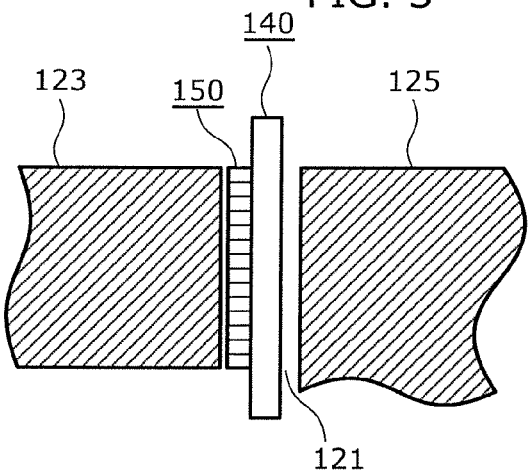
FIG. 3 is a sectional view illustrating one of different attachment positions of the concentrated polymer brush.
Figure 4:
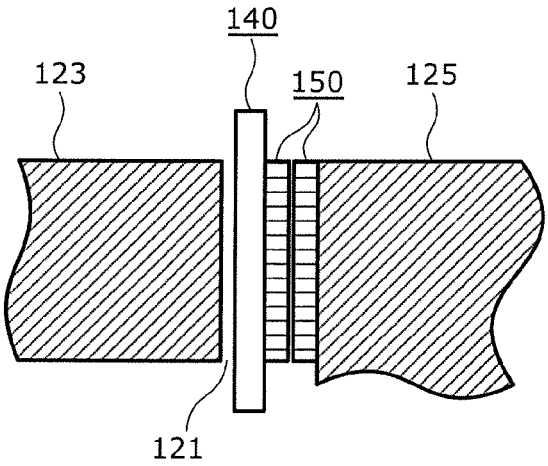
FIG. 4 is a sectional view illustrating one of different attachment positions of the concentrated polymer brush.
Figure 5:
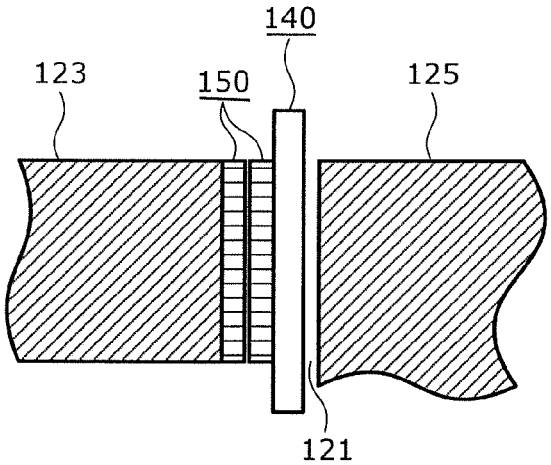
FIG. 5 is a sectional view illustrating one of different attachment positions of the concentrated polymer brush.
Figure 6:
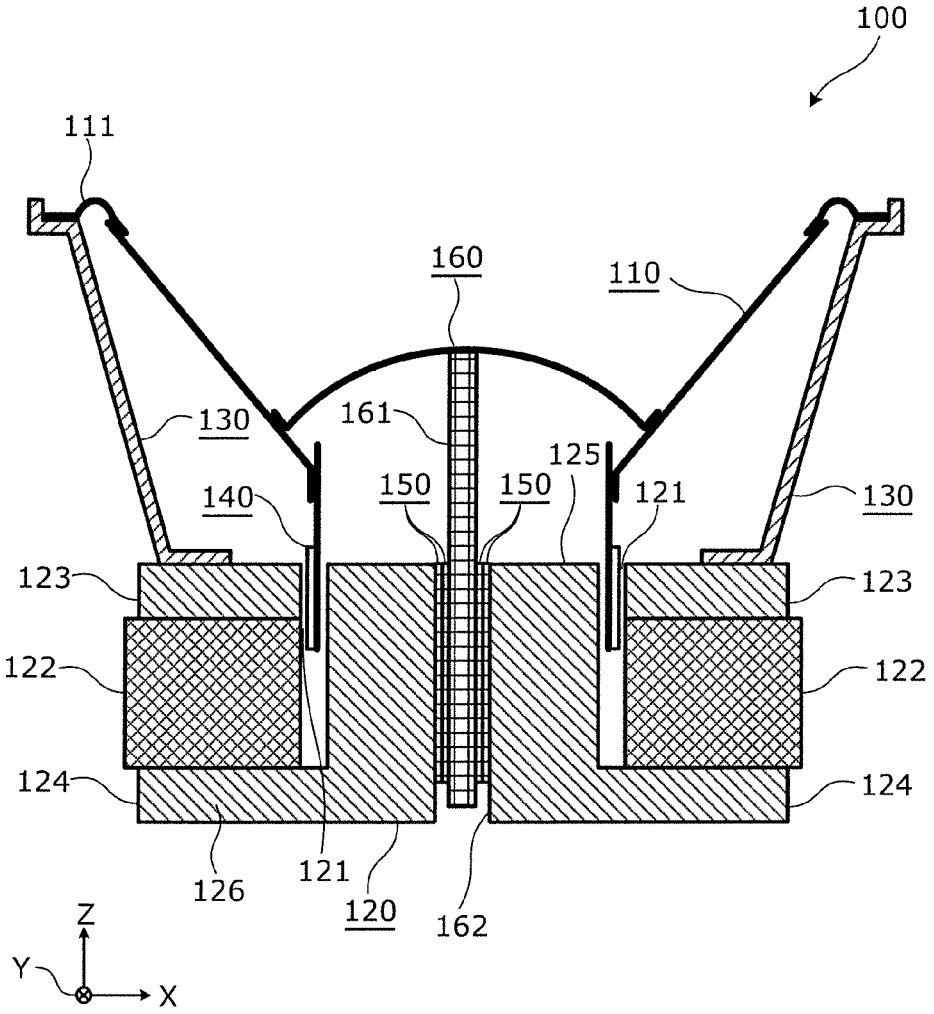
FIG. 6 is a sectional view illustrating a loudspeaker according to Embodiment 2.

It should be noted that the position of concentrated polymer brush 150 may be at least one of a position where voice coil 140 and center pole 125 slide over each other, or a position where voice coil 140 and top plate 123 slide over each other. In other words, concentrated polymer brush 150 is sufficient to be provided in a position where voice coil 140 and magnetic circuit 120 slide over each other. More specifically, as shown in FIG. 3, concentrated polymer brush 150 may be provided on the outer peripheral surface of voice coil 140. As shown in FIG. 4, concentrated polymer brush 150 may be provided on both the inner peripheral surface of voice coil 140 and the outer peripheral surface of center pole 125 which is the inner peripheral surface of magnetic gap 121. As shown in FIG. 5, concentrated polymer brush 150 may be also provided on both the outer peripheral surface of voice coil 140 and the inner peripheral surface of top plate 123 which is the outer peripheral surface of magnetic gap 121.

Moreover, a surface treatment may be applied to a portion on which polymer compounds are provided in center pole 125 and voice coil 140 forming the sliding portion, for example. With this, the polymer compounds such as concentrated polymer brush 150 can be more firmly adhered to the surface of center pole 125, voice coil 140, or the like, and thus it is possible to enhance the life of the sliding portion.

In the surface treatment applied to a portion on which polymer compounds are provided, i.e., center pole 125, voice coil 140, or the like, it is desired to alter the surface to be able to react with and be covalently bound to Si—OR structures which act on fixing of initiating groups in polymerization. More specifically, for example, the surface treatment is performed such that the Si—OH structures are arranged side by side on the surface of the sliding portion.

The surface of the sliding portion in center pole 125 of a loudspeaker, etc., is galvanized and coated with trivalent chromate. However, this surface state shows low reactivity with the Si—OH structures which are in charge of binding to the polymer compounds (polymer brush). Accordingly, it is desired to be coated with silica having the Si—OH structures which are theoretically the most reactive. The silica coating is a process in which a surface is coated with glass particles of silicon dioxide (silica) or the like.

Embodiment 2

Next, another embodiment of electroacoustic transducer 100 will be described. It should be noted that components (parts) having substantially the same effect, function, shape, mechanism, and structure as Embodiment 1 are assigned with the same reference signs, and redundant descriptions will be omitted. Moreover, the following mainly focuses on differences from Embodiment 1, and duplicate descriptions will be omitted.

In Embodiment 2, as a component different from voice coil 140, electroacoustic transducer 100 includes round-bar shaped first component 161 having one end coupled to center cap 160 and extending toward magnetic circuit 120. First component 161 is coupled to diaphragm 110 through center cap 160. Moreover, center pole 125 of magnetic circuit 120 also serving as the second component includes through-hole shaped guide 162 for guiding first component 161 along one axis.

Moreover, in Embodiment 2, concentrated polymer brush 150 is provided facing both first component 161 and guide 162.

In Embodiment 2, selection of the material or surface state of first component 161 serving as one of components in a guide system is flexible, and thus the material or surface state appropriate to fixing of concentrated polymer brush 150 or sliding against concentrated polymer brush 150 can be selected as necessary.

In a similar manner as Embodiment 1, first component 161 according to Embodiment 2 is in contact with the inner peripheral surface of guide 162 through two layers of concentrated polymer brush 150, and thus first component 161 is guided only in a back and forth direction which is an extending direction of guide 162. Accordingly, the vibration of diaphragm 110 coupled to first component 161 is limited to only the back and forth direction. Diaphragm 110 vibrated by the movement of voice coil 140 vibrates in the back and forth direction while being prevented from waving or laterally vibrating, thereby achieving production of sound true to original sound.

With diaphragm 110, the movement of voice coil 140 is also limited to only one axis direction which is the extending direction of guide 162, and thus the gap length of magnetic gap 121 in magnetic circuit 120 can be significantly shortened. Accordingly, it is possible to increase the magnetic flux density generated in magnetic gap 121, thereby achieving electroacoustic transducer 100 capable of producing high sound pressure.

It should be noted that the position of concentrated polymer brush 150 may be on either one of first component 161 and guide 162.

It should be noted that the present disclosure is not limited to the foregoing embodiments. For example, another embodiment realized by arbitrarily combining structural components or excluding some structural elements described in this written description may be included as an embodiment of the present disclosure. Moreover, variations obtained by various modifications to the foregoing embodiments that can be conceived by a person having ordinary skill in the art, that are within the scope of the essence of the present disclosure, that is, the intended teachings of the recitations of the claims, are also included in the present disclosure.

For example, in the foregoing embodiments, electroacoustic transducer 100 that converts an electrical signal into sound is illustrated as an example, but electroacoustic transducer 100 may be a microphone or a sensor that converts an electrical signal into sound.

Moreover, the case in which one first component 161 is coupled to the center of center cap 160 is illustrated as an example, but first component 161 may be directly coupled to diaphragm 110 when no center cap 160 is provided or the like. Moreover, multiple first components 161 may be coupled to diaphragm 110 or center cap 160.

Moreover, the shapes of diaphragm 110, magnetic circuit 120, and voice coil 140 are illustrated as a circle in plan view, but the shapes are not limited to this. The shapes may be oval or rectangular in plan view.

Moreover, the type of magnetic circuit 120 is not limited to the outer magnet type and the inner magnet type. A mixed structure of the outer magnet type and the inner magnet type is also possible.

Moreover, the magnet for use in magnetic circuit 120 may be any magnet such as samarium-iron magnet, ferrite magnet, or neodymium magnet.

Furthermore, a cone-type loudspeaker broadly applied to cars or audio and visual fields is mainly illustrated as the electroacoustic transducer, but it can be applied to a compact micro speaker or a receiver for use in a smart phone, a mobile phone, a personal computer, a headphone, an earphone, etc., and a similar effect can be exerted.

Figure 7:
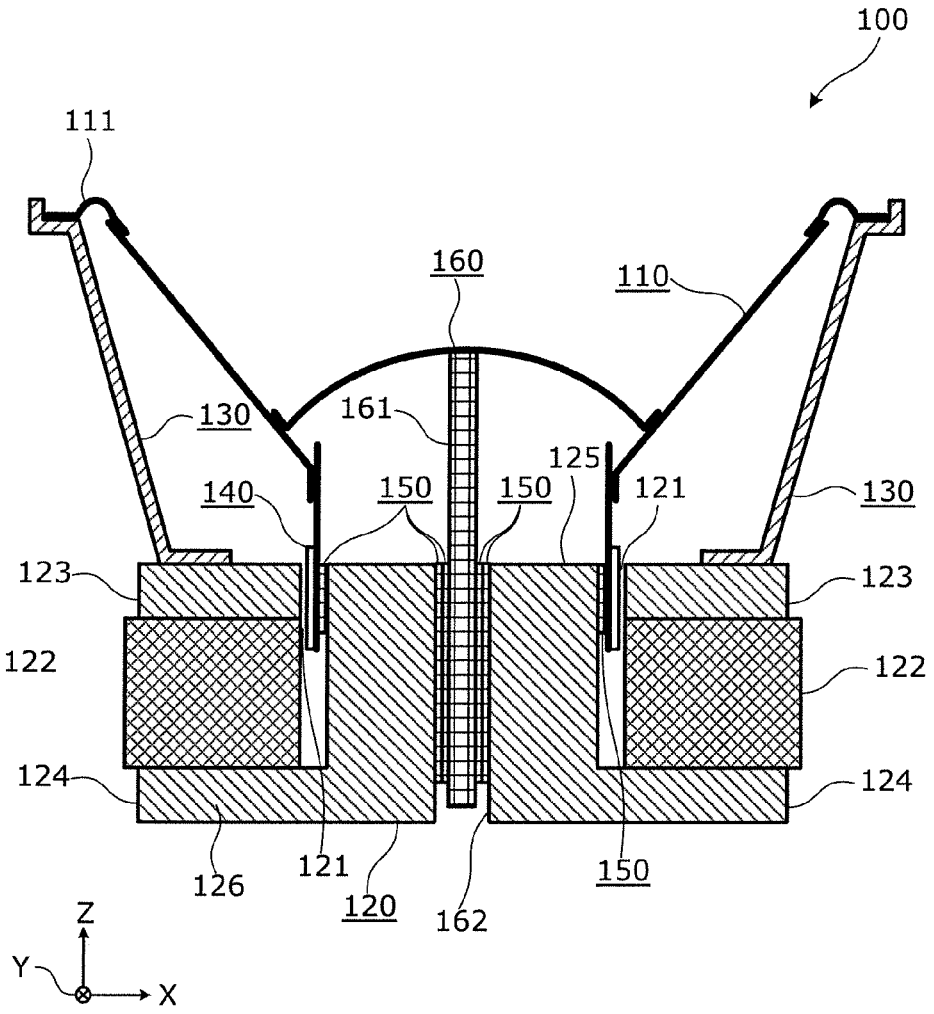
FIG. 7 is a sectional view illustrating a loudspeaker according to another embodiment.

Moreover, as shown in FIG. 7, concentrated polymer brush 150 may be provided between first component 161 and guide 162 and in magnetic gap 121.

It should be noted that instead of concentrated polymer brush 150, a polymer brush may be employed as the polymer compounds in the low friction material as described above. Even using the polymer brush, the present disclosure is functionally implementable although the effect may be reduced. In addition to the polymer brush which is not three-dimensional crosslinked, the stress concentration relief structure of the polymer compounds may be a sea-island structure including the first three-dimensional crosslinked polymer and the second three-dimensional crosslinked polymer which is more flexible than the first three-dimensional crosslinked polymer, and a component in which the amount of the second three-dimensional crosslinked polymer is at least 20 times as great as the amount of the first three-dimensional crosslinked polymer may be employed. The polymer compounds having the sea-island structure transform into a soft gel state as a whole by being swollen with liquid 153. Relatively flexible polymer compounds can develop the toughness by reducing the stress concentration, liquid 153 can develop the good sliding properties, and relatively rigid polymer compounds can develop the heat resisting properties and the shape holding properties.

While various embodiments have been described herein above, it is to be appreciated that various changes in form and detail may be made without departing from the spirit and scope of the present disclosure as presently or hereafter claimed.

Further Information about Technical Background to this Application

The disclosure of the following Japanese Patent Application including specification, drawings and claims are incorporated herein by references on its entirety: Japanese Patent Application No. 2017-189165 filed on Sep. 28, 2017.

INDUSTRIAL APPLICABILITY

The present disclosure is useful for a high-sound-pressure loudspeaker, a compact loudspeaker, a lightweight loudspeaker, a high-performance microphone, a high-performance sensor, etc.

The invention claimed is:

1. An electroacoustic transducer, comprising:

a sliding portion; and a low friction material in the sliding portion, wherein the low friction material includes polymer compounds swollen with liquid, the polymer compounds have a stress concentration relief structure which is a polymer brush, a plurality of polymer chains of the polymer brush are chemically or physically fixed to a surface of a voice coil or a magnetic gap of the electroacoustic transducer, and the polymer compounds are swollen with liquid, and the plurality of polymer chains are vertically elongated from the surface of the voice coil or the magnetic gap.

2. The electroacoustic transducer according to claim 1, wherein the stress concentration relief structure is a sea-island structure including a first three-dimensional crosslinked polymer and a second three-dimensional crosslinked polymer which is more flexible than the first three-dimensional crosslinked polymer, and an amount of the second three-dimensional crosslinked polymer is at least 20 times as great as an amount of the first three-dimensional crosslinked polymer.

3. The electroacoustic transducer according to claim 1, wherein the liquid has a high liquidity ranging from 1 mPa·s to 2000 mPa·s inclusive at room temperature, and a boiling point of at least 180 degrees Celsius.

4. The electroacoustic transducer according to claim 1, further comprising:

a diaphragm that produces sound by vibration or vibrates by sound; and a guide system that guides vibration for the diaphragm along one axis, wherein the guide system includes:

a first component coupled to the diaphragm; and a second component that guides the first component along the one axis, and forms the sliding portion along with the first component.

5. The electroacoustic transducer according to claim 4, further comprising:

a magnetic circuit having a magnetic gap opposite the diaphragm;

a frame that holds the diaphragm and the magnetic circuit; and a voice coil having one end portion positioned within the magnetic gap and the other end portion coupled to the diaphragm, wherein the voice coil is used as the first component, and the magnetic circuit is used as the second component, and the low friction material is applied to at least one of an outer peripheral surface of the voice coil, an inner peripheral surface of the voice coil, an outer peripheral surface of the magnetic gap, or an inner peripheral surface of the magnetic gap.

6. The electroacoustic transducer according to claim 4, wherein the first component is a bar-shaped component extending from the diaphragm or a center cap toward a magnetic circuit, the magnetic circuit also serving as the second component includes a guide that guides the first component along one axis, and the low friction material is applied to at least one of the first component or the guide.

7. The electroacoustic transducer according to claim 5, wherein a gap length of the magnetic gap is longer than and at most three times as long as a thickness of the voice coil.

8. The electroacoustic transducer according to claim 5, wherein a clearance between the magnetic gap and a part of the voice coil inserted into the magnetic gap is at least 0.01 μm and less than 80 μm.

9. The electroacoustic transducer according to claim 1, wherein a surface treatment is applied to the sliding portion.

10. The electroacoustic transducer according to claim 9, wherein the surface treatment is silica coating.

11. The electroacoustic transducer according to claim 1, wherein a voice coil and a frame are supported by a damper.

12. An electroacoustic transducer, comprising:

a magnetic circuit having a magnetic gap opposite a diaphragm;

a frame that holds the diaphragm and the magnetic circuit; and a voice coil having one end portion positioned within the magnetic gap and the other end portion coupled to the diaphragm, and wherein the low friction material is applied to at least one of an outer peripheral surface of the voice coil, an inner peripheral surface of the voice coil, an outer peripheral surface of the magnetic gap, or an inner peripheral surface of the magnetic gap, and includes polymer compounds swollen with liquid, the polymer compounds have a stress concentration relief structure which is a polymer brush a plurality of polymer chains of the polymer brush are chemically or physically fixed to a surface of the voice coil or a magnetic gap of the electroacoustic transducer, and the polymer compounds are swollen with liquid, and the plurality of polymer chains are vertically elongated from the surface of the voice coil or the magnetic gap.

13. The loudspeaker according to claim 12, further comprising:

a first component that is bar-shaped and extends from the diaphragm or a center cap toward the magnetic circuit, wherein the magnetic circuit includes a guide that guides the first component along one axis, and the low friction material is applied to at least one of the first component or the guide.

14. A loudspeaker, comprising: a sliding portion; and a low friction material in the sliding portion, wherein the low friction material includes polymer compounds swollen with liquid, the loudspeaker further comprises:

a magnetic circuit having a magnetic gap opposite a diaphragm;

a frame that holds the diaphragm and the magnetic circuit;

a voice coil having one end portion positioned within the magnetic gap and the other end portion coupled to the diaphragm; and a first component that is bar-shaped and extends from the diaphragm or a center cap toward the magnetic circuit, the magnetic circuit includes a guide that guides the first component along one axis, and the low friction material is applied to at least one of the first component or the guide.

* * * * *